US012550983B2

(12) United States Patent
Kozak

(10) Patent No.: US 12,550,983 B2
(45) Date of Patent: Feb. 17, 2026

(54) RATCHET BUCKLE

(71) Applicant: KORE Essentials Inc., Santee, CA (US)

(72) Inventor: Karl Kozak, Santee, CA (US)

(73) Assignee: KORE Essentials Inc., Santee, CA (US)

( * ) Notice: Subject to any disclaimer, the term of this patent is extended or adjusted under 35 U.S.C. 154(b) by 148 days.

(21) Appl. No.: 18/340,844

(22) Filed: Jun. 24, 2023

(65) Prior Publication Data

US 2024/0225203 A1 Jul. 11, 2024

Related U.S. Application Data

(60) Provisional application No. 63/437,549, filed on Jan. 6, 2023.

(51) Int. Cl.
*A44B 11/12* (2006.01)
*F41C 33/04* (2006.01)

(52) U.S. Cl.
CPC ..... *A44B 11/12* (2013.01); *F41C 33/046* (2013.01)

(58) Field of Classification Search
CPC ..... A44B 11/12; A44B 11/006; A44B 11/125; A44B 11/06; A44B 11/065; A44B 11/20; F41C 33/046; A41F 9/002; A41F 9/025; Y10S 24/48; Y10T 24/4016; Y10T 24/4072; Y10T 24/44248; Y10T 24/44496; Y10T 24/45246; Y10T 24/4086; Y10T 24/4077; Y10T 24/1498; Y10T 2/321; Y10T 2/322
USPC ..... 24/DIG. 43, DIG. 44, DIG. 46, DIG. 47, 24/DIG. 48
See application file for complete search history.

(56) References Cited

U.S. PATENT DOCUMENTS 1,483,853 A * 2/1924 Schwerd ..... A44B 11/00 24/587.12
1,635,135 A * 7/1927 Mix ..... A44B 11/125 24/191
1,643,083 A * 9/1927 Otten ..... A44B 11/12 24/191
1,887,825 A * 11/1932 Statham ..... A41F 1/008 24/593.11
2,474,372 A * 6/1949 Schmith ..... A44B 11/00 24/647

(Continued)

*Primary Examiner* — Jason W San
*Assistant Examiner* — Rowland Do
(74) *Attorney, Agent, or Firm* — CP LAW GROUP PC; Cy Bates

(57) ABSTRACT

A ratchet buckle and belt system are disclosed. The ratchet belt includes a ratcheting mechanism configured to releasably engage with a notch strip of the belt. The ratcheting mechanism has a first pawl and a second pawl each rotatably coupled to a ratchet pin. The first pawl includes a first ratcheting tab and a first release lever wherein the first release lever is configured to rotate the first pawl and disengage the first ratcheting tab from the notch strip. The second pawl includes a second ratcheting tab and a second release lever wherein the second release lever is configured to rotate the second pawl and disengage the second ratcheting tab from the notch strip. When both the first and second ratcheting tabs are simultaneously disengaged from the notch strip, the ratcheting mechanism is disengaged from the belt forming a disengaged configuration.

14 Claims, 7 Drawing Sheets

(56) References Cited

U.S. PATENT DOCUMENTS

| | | | | | |
|---|---|---|---|---|---|
| 3,152,374 | A * | 10/1964 | Round | A44B 11/10 | D11/216 |
| 4,669,155 | A * | 6/1987 | Chen | A41F 9/002 | 24/191 |
| 4,727,630 | A * | 3/1988 | Alan | A44B 11/06 | 24/593.11 |
| 4,999,846 | A * | 3/1991 | Ball | A42B 1/22 | 2/418 |
| 5,572,747 | A * | 11/1996 | Cheng | A44B 11/12 | 2/322 |
| 5,579,563 | A * | 12/1996 | Sim | A44B 11/2592 | 24/615 |
| 5,588,184 | A * | 12/1996 | Chen | A41F 9/007 | 24/191 |
| 5,588,186 | A * | 12/1996 | Ko | A44B 11/14 | 24/DIG. 48 |
| 5,752,298 | A * | 5/1998 | Howell | A44B 11/12 | 2/418 |
| 6,715,449 | B1 * | 4/2004 | Jordan | A01K 27/005 | 24/DIG. 48 |
| 9,149,090 | B1 * | 10/2015 | Taylor | A44B 11/006 | |
| 9,277,776 | B2 * | 3/2016 | Laatz | A41F 9/002 | |
| 9,351,526 | B1 * | 5/2016 | Taylor | A44B 11/125 | |
| 9,615,631 | B2 * | 4/2017 | Laatz | A44B 11/125 | |
| 10,130,131 | B2 * | 11/2018 | Ryou | A41F 1/008 | |
| 10,219,585 | B2 * | 3/2019 | Taylor | A44B 11/006 | |
| 10,667,582 | B2 * | 6/2020 | Hestvik | A44B 11/12 | |
| 11,950,663 | B1 * | 4/2024 | Rowland | A44B 11/16 | |
| 2006/0277727 | A1 * | 12/2006 | Keene | A44B 11/2526 | 24/638 |
| 2012/0297591 | A1 * | 11/2012 | Bozzetto | A43C 11/146 | 24/191 |
| 2013/0167288 | A1 * | 7/2013 | Rowland | A41F 9/002 | 2/338 |

* cited by examiner

RATCHET BUCKLE

CROSS-REFERENCE TO RELATED APPLICATIONS

This application claims benefit of priority with U.S. Provisional Application Ser. No. 63/437,549, filed Jan. 6, 2023; the entire contents of which are hereby incorporated by reference.

BACKGROUND

Field of the Invention

This invention relates to a belt buckle and related buckle and belt system, and more particularly to a belt buckle with a ratchet mechanism configured to engage with a notch strip.

Description of the Related Art

Duty belts are a common accessory with law enforcement personnel. The duty belt provides a stable platform for duty equipment including holster and pouches. Some duty belts include a ratchet buckle for engagement with a notch strip on the belt. The ratchet buckle may be configured to disengage from the belt via a release lever that can be either pushed or pulled by the user. The user of the duty belt may engage in physical encounters with suspects where the suspect may have access to the user's duty belt and may attempt to easily disengage the duty belt by pressing on the release lever.

There exists a need to prevent unwanted disengagement of the duty belt.

SUMMARY

A ratchet buckle and related buckle and belt system are disclosed. The ratchet belt comprises a ratcheting mechanism configured to releasably engage with a notch strip of a belt. The ratcheting mechanism comprises a first pawl and a second pawl each rotatably coupled to a ratchet pin wherein the first and second pawls are independently coupled to the ratchet pin. The first pawl comprises a first ratcheting tab and a first release lever wherein the first release lever is configured to rotate the first pawl and disengage the first ratcheting tab from the notch strip. The second pawl comprises a second ratcheting tab and a second release lever wherein the second release lever is configured to rotate the second pawl and disengage the second ratcheting tab from the notch strip. When both the first and second ratcheting tabs are simultaneously disengaged from the notch strip, the ratcheting mechanism is disengaged from the belt forming a disengaged configuration. If the first ratcheting tab, the second ratcheting tab, or both remain engaged with the notch strip, the ratcheting mechanism remains engaged with the belt forming an engaged configuration.

BRIEF DESCRIPTION OF THE DRAWINGS

Other features, combinations, and embodiments will be appreciated by one having the ordinary level of skill in the art upon a thorough review of the following details and descriptions, particularly when reviewed in conjunction with the drawings, wherein.

DETAILED DESCRIPTION

Figure 1:
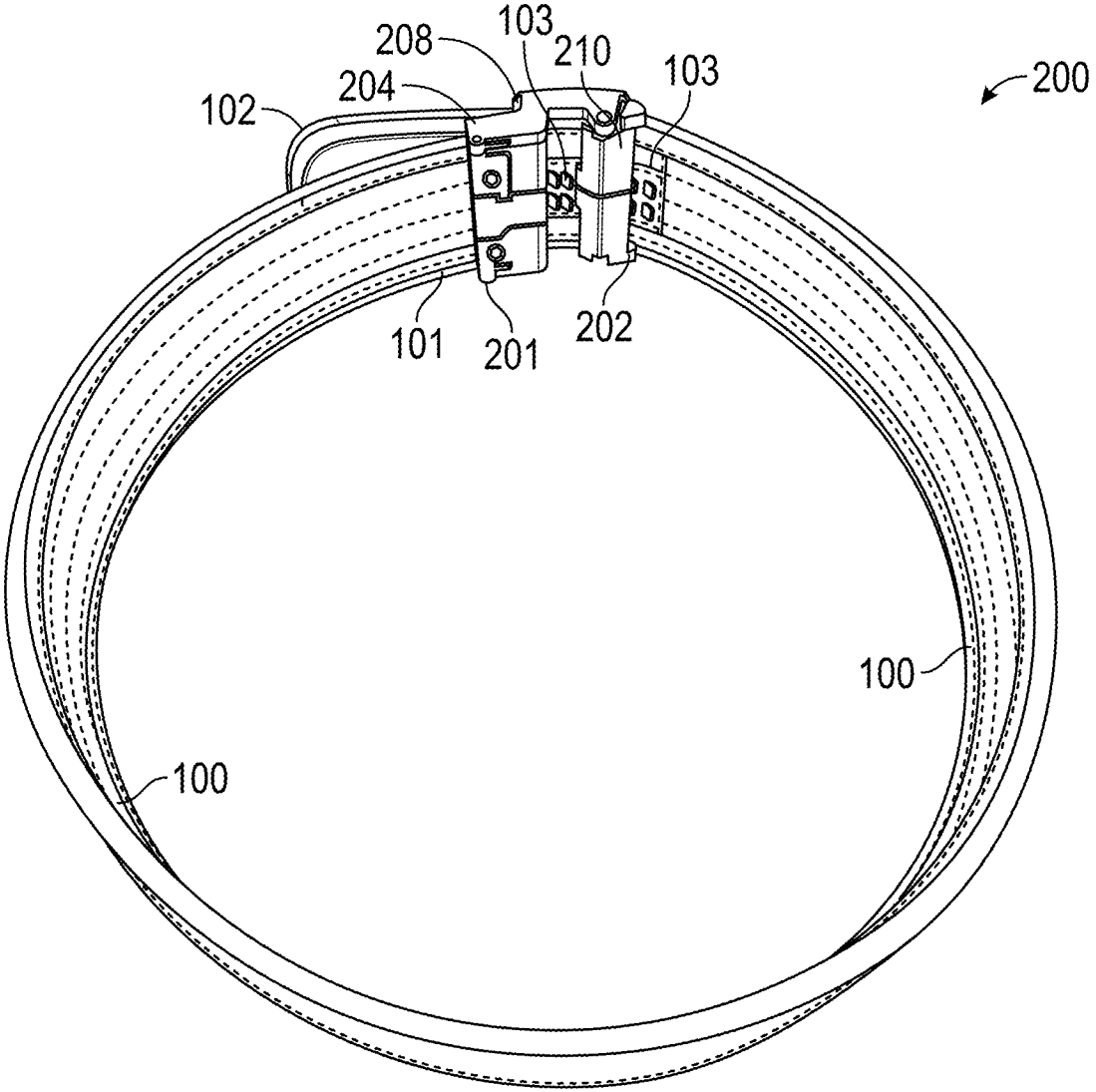
FIG. 1 shows a perspective view of a belt and a buckle in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

Unless explicitly defined herein, terms are to be construed in accordance with the plain and ordinary meaning as would be appreciated by one having skill in the art.

General Description of Embodiments

In one embodiment, a ratchet buckle configured to engage a belt having a notch strip is disclosed. The ratchet buckle comprises a body extending from a first side to a second side and a receptacle portion disposed at the first side, the receptacle portion being configured to fixedly couple to the belt. A ratchet pin extends across the body, wherein the ratchet pin is disposed between the first side and the second side. A ratcheting mechanism is disposed adjacent to the second side, the ratcheting mechanism comprises a first pawl and a second pawl. The first pawl is rotatably coupled to the ratchet pin. The first pawl comprises a first ratcheting tab and a first release lever, where the first release lever is configured to rotate the first pawl and disengage the first ratcheting tab from the notch strip. The second pawl is also rotatably coupled to the ratchet pin. The second pawl comprises a second ratcheting tab and second release lever where the second release lever is configured to rotate the second pawl and disengage the second ratcheting tab from the notch strip. The first pawl and the second pawl are separate and distinct. The ratcheting mechanism is configured to disengage from the belt when both the first and second ratcheting tabs are simultaneously disengaged from the notch strip.

In some embodiments, the first release lever and the second release lever may each extend away from the receptacle portion. In other embodiments, the first release lever and the second release lever may each extend towards the receptacle portion. In yet in other embodiments one of the first release lever and the second release lever may extend toward the receptacle portion and another of the first release lever and the second release lever may extend away from the receptacle portion In some embodiments, the ratchet buckle may further comprise a gap disposed between the first pawl and the second pawl. In some embodiments, the buckle may further comprise one or more washers disposed within the gap.

In some embodiments, the ratcheting mechanism may further comprise a first torsional spring coupled to each of the first pawl and the ratchet pin, and a second torsional spring coupled to each of the second pawl and the ratchet pin.

In some embodiments, the ratcheting mechanism may comprise a discrete locked position and a discrete released position.

In some embodiments, the first pawl may be in a mirror configuration with the second pawl.

In some embodiments, the ratchet pin may further comprise a first ratchet pin and a second ratchet pin such that the first ratchet pin and the second ratchet pin are separate and distinct, wherein the first pawl is rotatably coupled to the first ratchet pin and the second pawl is rotatably coupled to the second ratchet pin.

In some embodiments, the ratchet buckle may further comprise a first mechanical tab coupled to the first pawl and a second mechanical tab coupled to the second pawl wherein the first mechanical tab is configured to engage with a first groove of the body and the second mechanical tab is configured to engage with a second groover of the body.

In another embodiment, a ratchet buckle and belt system is disclosed. The system comprises a belt having a first end and a second end opposite the first end, the belt further comprising a notch strip disposed adjacent to the second end. The system further comprises a ratchet buckle comprising a body extending from a first side to a second side, and a receptacle portion disposed at the first side wherein the receptacle portion is configured to couple to the first end of the belt. A ratchet pin extends across the body, wherein the ratchet pin is disposed between the first side and the second side. A ratcheting mechanism is disposed adjacent to the second side, the ratcheting mechanism comprises a first pawl and a second pawl. The first pawl is rotatably coupled to the ratchet pin. The first pawl comprises a first ratcheting tab and a first release lever, where the first release lever is configured to rotate the first pawl and disengage the first ratcheting tab from the notch strip. The second pawl is also rotatably coupled to the ratchet pin. The second pawl comprises a second ratcheting tab and second release lever where the second release lever is configured to rotate the second pawl and disengage the second ratcheting tab from the notch strip. The first pawl and the second pawl are separate and distinct. The ratcheting mechanism is configured to disengage from the belt when both the first and second ratcheting tabs are simultaneously disengaged from the notch strip.

In some embodiments, the first release lever and the second release lever may each extend away from the receptacle portion. In other embodiments, the first release lever and the second release lever may each extend towards the receptacle portion. In yet in other embodiments one of the first release lever and the second release lever may extend toward the receptacle portion and another of the first release lever and the second release lever may extend away from the receptacle portion In some embodiments, the ratchet buckle may further comprise a gap disposed between the first pawl and the second pawl. In some embodiments, the buckle may further comprise one or more washers disposed within the gap.

In some embodiments, the ratcheting mechanism may further comprise a first torsional spring coupled to each of the first pawl and the ratchet pin, and a second torsional spring coupled to each of the second pawl and the ratchet pin.

In some embodiments, the ratcheting mechanism may comprise a discrete locked position and a discrete released position.

In some embodiments, the first pawl may be in a mirror configuration with the second pawl.

In some embodiments, the ratchet pin may further comprise a first ratchet pin and a second ratchet pin such that the first ratchet pin and the second ratchet pin are separate and distinct, wherein the first pawl is rotatably coupled to the first ratchet pin and the second pawl is rotatably coupled to the second ratchet pin.

In some embodiments, the ratchet buckle may further comprise a first mechanical tab coupled to the first pawl and a second mechanical tab coupled to the second pawl wherein the first mechanical tab is configured to engage with a first groove of the body and the second mechanical tab is configured to engage with a second groover of the body.

In some embodiments, the notch strip may further comprise a first row of a plurality of notches configured to engage with the first ratcheting tab, and a second row of a plurality of notches configured to engage with the second ratcheting tab.

Manufacturing

Each of the components of the ratchet buckle and belt described herein may be manufactured and/or assembled in accordance with the conventional knowledge and level of a person having skill in the art.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

Illustrated Embodiments

Now turning to the drawings, FIG. 1 shows a perspective view of a belt (100) and a buckle (200) in accordance with a first illustrated embodiment. The belt comprises a first end (101) and a second end (102). The buckle comprises a first side (201) and a second side (202) opposite the first side wherein a receptacle portion (204) is disposed at the first side and coupled to the first end of the belt. The belt includes a notch strip (103) disposed adjacent to the second end. The notch strip is configured to engage with a ratcheting mechanism (210) of the buckle. The second end of the belt is configured to slidably translate through the second side of the buckle and out an exit slot (208) thereof. The ratcheting mechanism creates a releasable engagement with the notch strip, thereby preventing the second end of the belt from disengaging from the buckle while the ratcheting mechanism is in a locked position.

Figure 2:
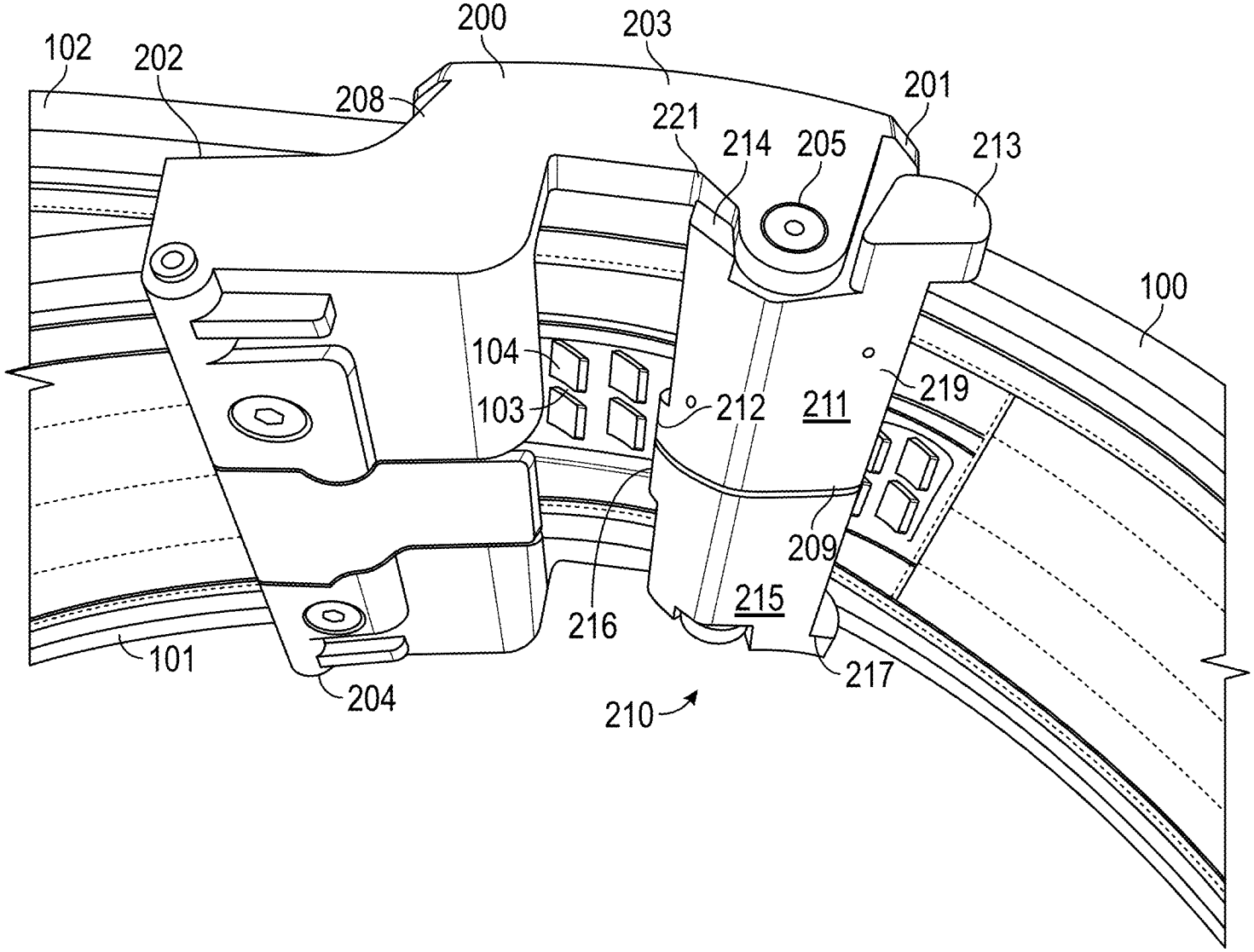
FIG. 2 shows a perspective view of the buckle with a ratchet mechanism according to the first illustrated embodiment.

FIG. 2 shows a perspective view of the buckle (200) with a ratchet mechanism (210) according to the first illustrated embodiment. The ratcheting mechanism comprises a first pawl (211) and a second pawl (215) each rotatably coupled to a ratchet pin (205) extending across a body (203) of the buckle. The first pawl comprises a first ratcheting tab (212) coupled to the first pawl. The first ratcheting tab is configured to engage with a belt (100) at a plurality of notches (104) of a notch strip (103) disposed thereon. Additionally, the second pawl comprises a second ratcheting tab (216) coupled to the second pawl. The second ratcheting tab is configured to engage with the plurality of notches. The first and second pawls comprise a first release lever (213) and a second release lever (217), respectively. The first and second release levers are each oriented away from a receptacle portion (204) of the buckle. The first release lever and the second release lever are configured to be independently pressed by a user, thereby lifting the first and second ratcheting tabs, respectively, from the notch strip.

Only once both the first release lever (213) and the second release lever (217) are pressed simultaneously, thereby simultaneously disengaging both the first and second ratcheting tabs (212; 216) from the notch strip (103), can the belt (100) disengage from the buckle (200). If only one of the first and second release levers is pressed, one of the ratcheting tabs (either first or second) will remain engaged with the notch strip and will prevent the belt from disengaging from the buckle.

In other embodiments, the first release lever (213) and the second release lever (217) extend from the first and second pawls (211; 215) towards the receptable portion (204), thereby requiring the user to pull the first and second release levers to rotate the first and second pawls, respectively. In yet other embodiments, one of the first and second levers extends away from the receptacle portion and the other of the first and second levers extends toward the receptable portion, thereby requiring the user to press on one of the first and second release levers and pull on the other of the first and second release levers to simultaneously lift both the first ratcheting tab (212) and the second ratcheting tab (216).

The first pawl (211) and the second pawl (215) are each rotatably coupled to a rachet pin (215). A gap (209) is present between the first and second pawls. The first and second pawls are coupled independently to the ratchet pin. Rotation of one of the first and second pawls does not require rotation of the other of the first and second pawls. In some embodiments, a first torsional spring may be coupled with the first pawl and the ratchet pin, thereby creating a spring bias to the first pawl being in a first rotation direction (219) of a locked position. In some embodiments, a second torsional spring may be coupled with the second pawl and the ratchet pin, thereby creating a spring bias to the second pawl being in the first rotation direction of a locked position. It will be appreciated that in such embodiments, the first and second torsional springs are independent and distinct from each other. In other embodiments, the first and second pawl do not comprise a spring and instead the first and second pawls are designed to be in a discrete locked position or a discrete released position such that a minimum force is required by the user to change the first or second pawl from one of the locked or released position to the other. In such an embodiment, simultaneously actuation of the first and second release levers is not required. Once a release lever is actuated into a released state it remains in the released state until actuated again into the locked. Therefore, a user may actuate the first release lever, and then actuate the second release lever after. When the first and second ratcheting tabs are together in the released state will the belt disengage from the buckle.

As shown, the ratcheting mechanism (210) comprises a single ratchet pin (205) being coupled to both the first and second pawls (211; 215). In other embodiments, the ratcheting mechanism may comprise a first ratchet pin and a second ratchet pin wherein the first ratchet pin is coupled to the first pawl and the second ratchet pin is coupled to the second pawl such that the first and second ratchet pins are independent and distinct.

As shown, the first pawl (211) can be characterized as being in a mirror configuration with the second pawl (215). In other embodiments, the first and second pawls can be characterized as not being in a mirror configuration.

Figure 3:
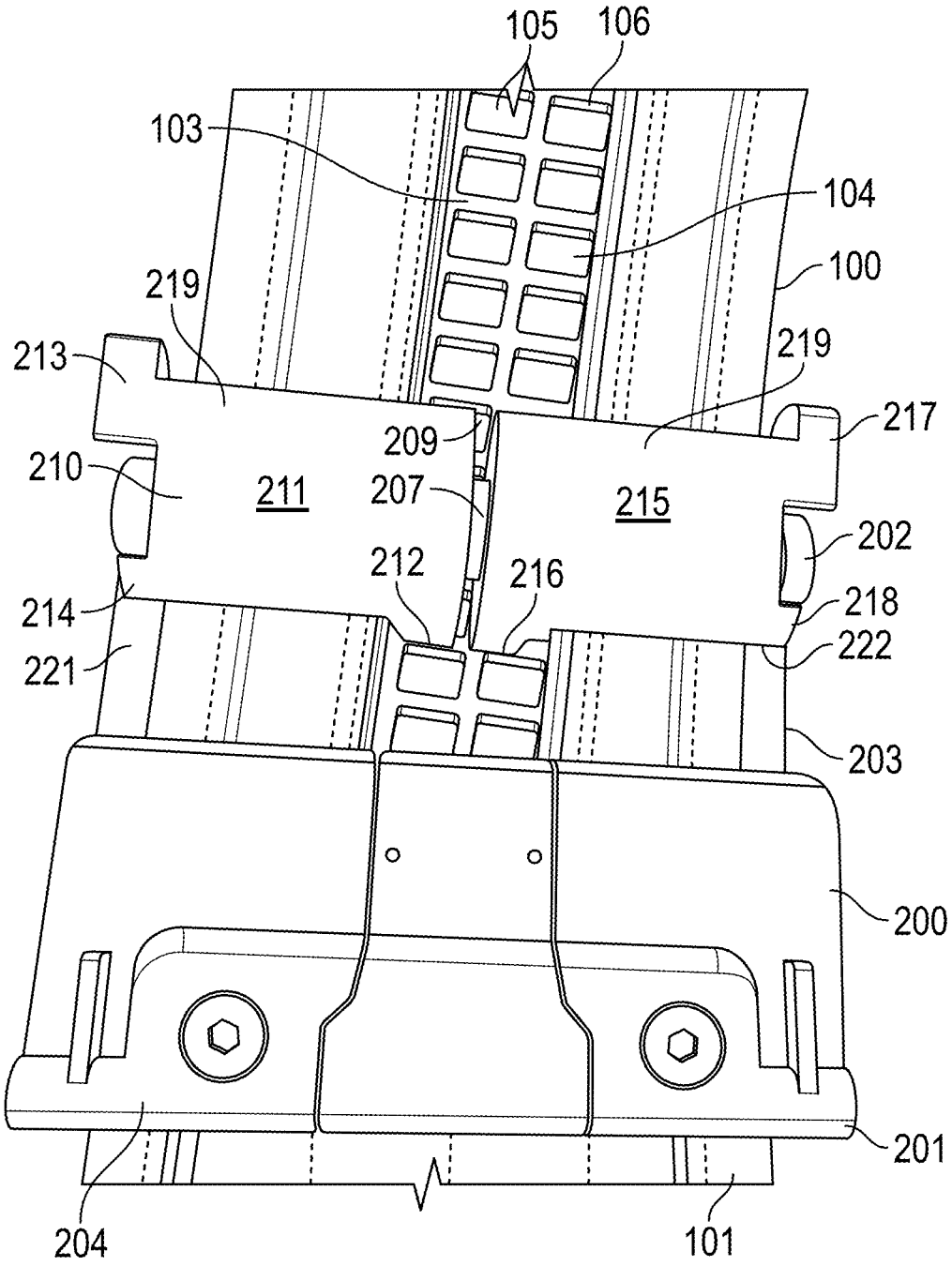
FIG. 3 shows a top view of the buckle with ratchet mechanism according to the first illustrated embodiment.

FIG. 3 shows a top view of the buckle (200) with ratchet mechanism (210) according to the first illustrated embodiment. The buckle comprises a first side (201), a second side (202), and a body (203) disposed therebetween. Disposed at the first side is a receptable portion (204) configured to couple with a first end (101) of a belt (100). Disposed adjacent to the second side is the ratchet mechanism. The ratchet mechanism is configured to releasably engage with a notch strip (103) of the belt having a plurality of notches (104). In some embodiments, the notch strip comprises a first row of plurality of notches (105) and a second row of plurality of notches (106) wherein the first and second row are in a parallel alignment.

The ratcheting mechanism (210) comprises a first pawl (211) having a first ratcheting tab (212) and a second pawl (215) having a second ratcheting tab (216). The first ratcheting tab is configured to engage with the first row of plurality of notches (105). The second ratcheting tab is configured to engage with the second row of plurality of notches (106). The first pawl and second pawl further comprise a first release lever (213) and a second release lever (217), respectively. The first and second release levers are configured to be pushed (or pulled in other embodiments), which causes the first and second pawls to rotate about a ratchet pin (not shown) which is rotatably coupled to both the first and second pawls. Rotation of the first and second pawls lifts the first and second ratcheting tabs away from the notch strip, thereby disengaging the first and second ratcheting tabs from the first and second rows respectively. Once the first and second ratcheting tabs are disengaged at the same time, the belt (100) can releasably disengage from the buckle (200) by translating out of the first side (202).

As shown, the first and second pawls (211; 215) are in a first rotation direction (219) of a locked position where the first and second ratcheting tabs (212; 216) are each engaged with the notch strip (103). When the first release lever (213) is pressed, the first pawl will subsequently be in a second rotation direction of a released state. When the second release lever (217) is pressed, the second pawl will subsequently be in the second rotation direction of the released state. The first and second pawls are each rotatably coupled to a ratchet pin (now shown) with a gap (209) disposed between the first and second pawls. One or more washers (207) are disposed at the gap between the first and second pawls. The one or more washers prevent the first and second pawls from sliding along the ratchet pin and creating undesirable friction to the first pawl, the second pawl, or both.

The first pawl (211) further comprises a first mechanical stop tab (214) to prevent over rotation. The first mechanical stop tab is configured to abut a first groove (221) of the buckle (200). The second pawl further comprises a second mechanical stop tab (218) to prevent over rotation. The second mechanical stop tab is configured to abut a second groove (222) of the buckle.

Figure 4:
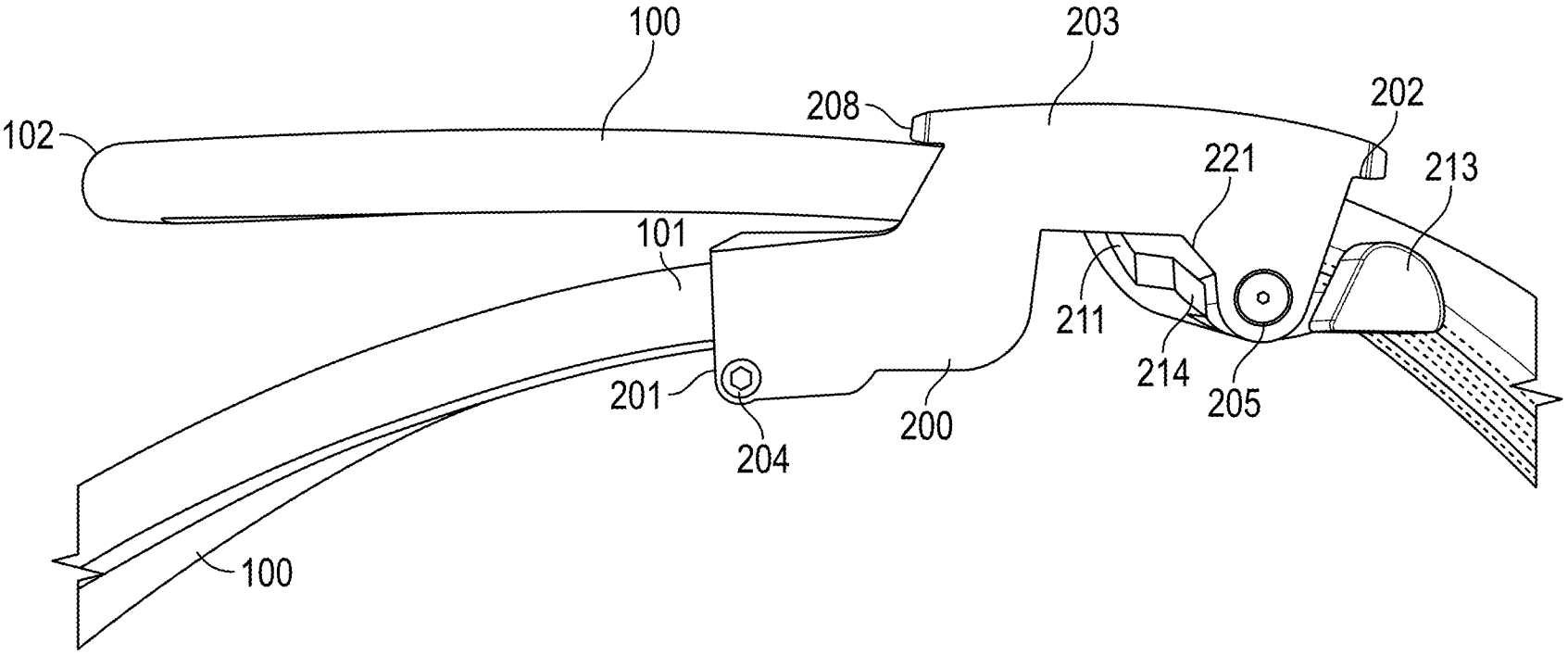
FIG. 4 shows a left side view of the belt and buckle according to the first illustrated embodiment.
Figure 5:
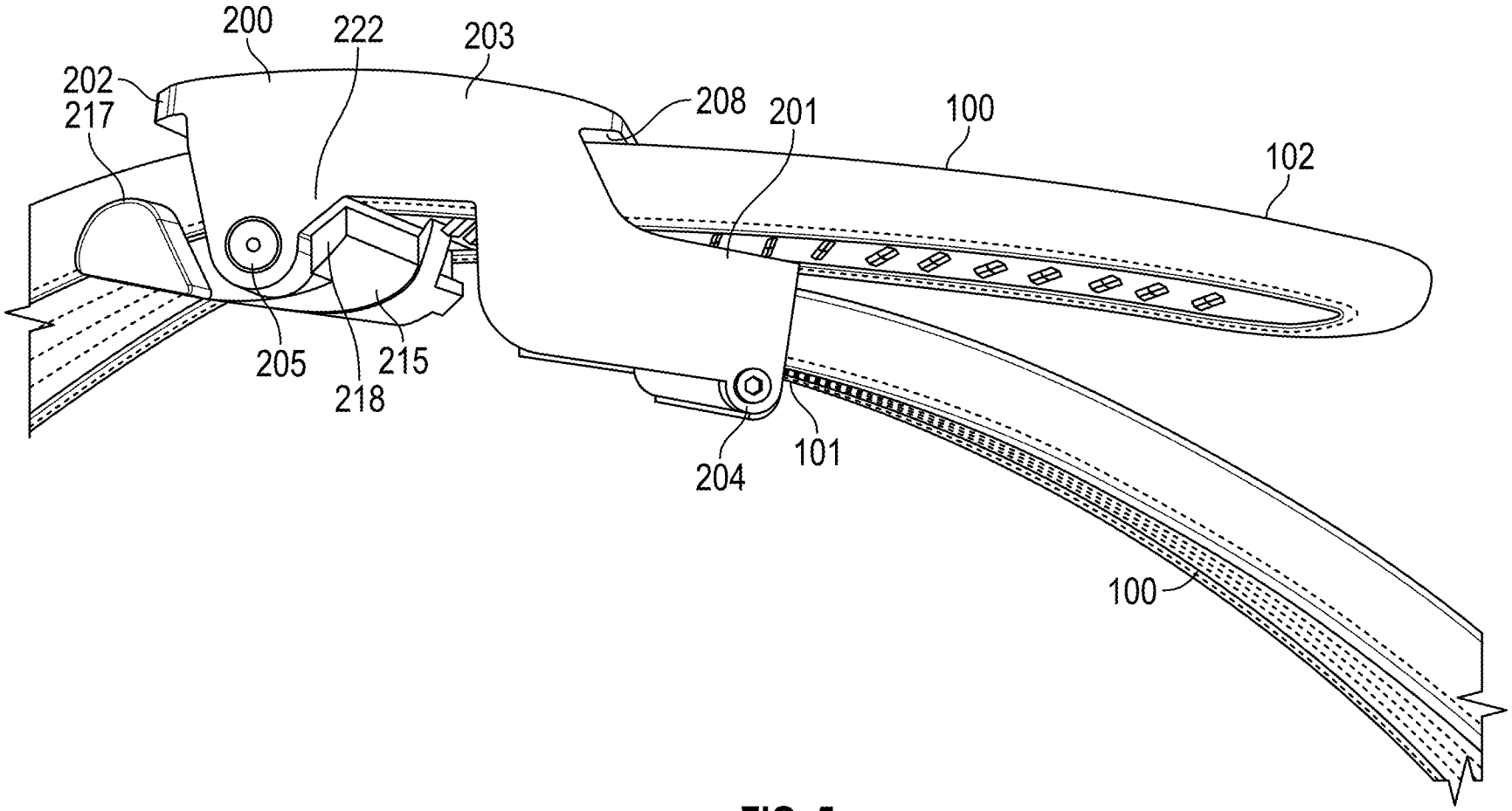
FIG. 5 shows a right side view of the belt and buckle according to the first illustrated embodiment.

FIG. 4 and FIG. 5 show a left and right side view, respectively, of the belt (100) and buckle (200). The belt includes a first end (101) and a second end (102) opposite the first end. The first end is coupled to a first side (201) of the buckle at a receptable portion (204). The second end is shown extending through the buckle and out of an exit slot (208) thereof. The buckle includes a first pawl (211) having a first release lever (213) wherein the first pawl is rotatably coupled to a rachet pin (205). The buckle further includes a second pawl (215) having a second release lever (217) wherein the second pawl is rotatably coupled to the ratchet pin. The first and second pawls are configured to independently rotate about the ratchet pin.

Figure 6:
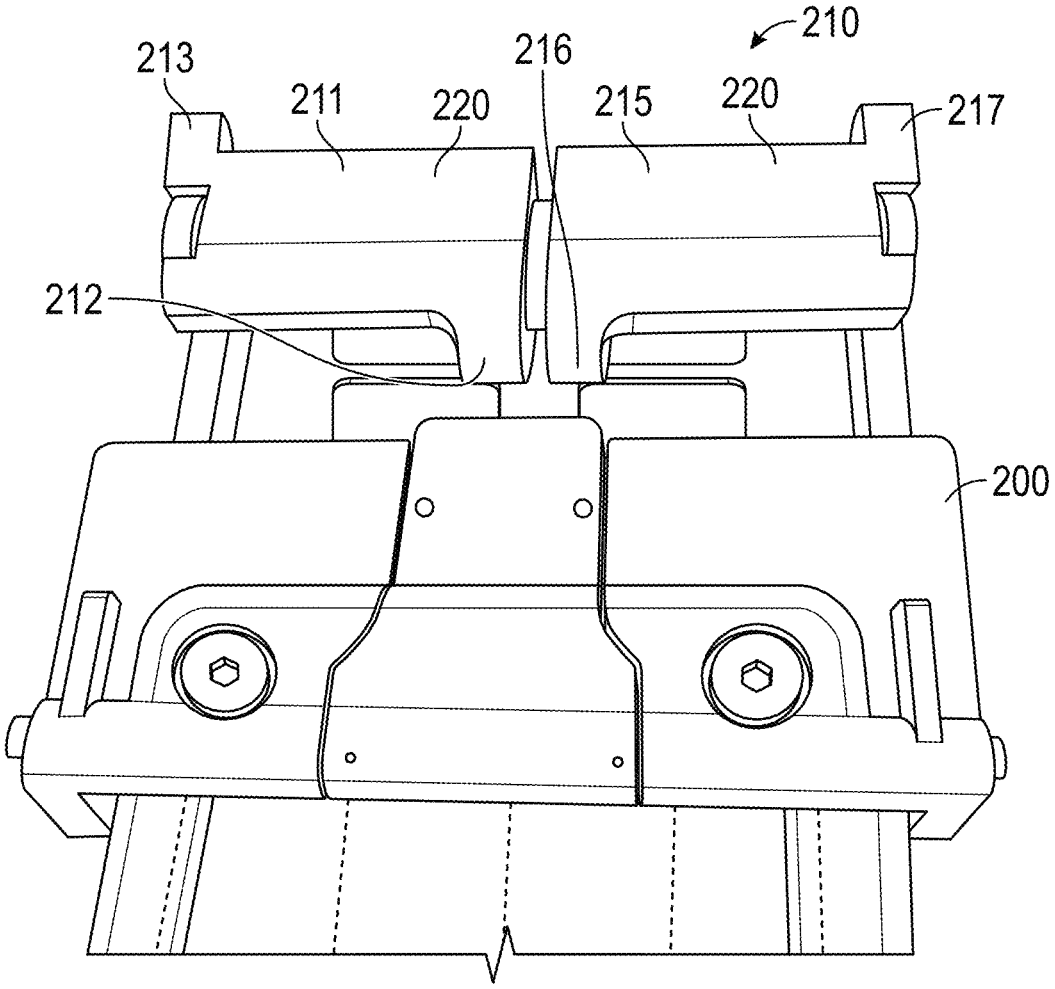
FIG. 6 shows a front view of the buckle according to the first illustrated embodiment.
Figure 7:
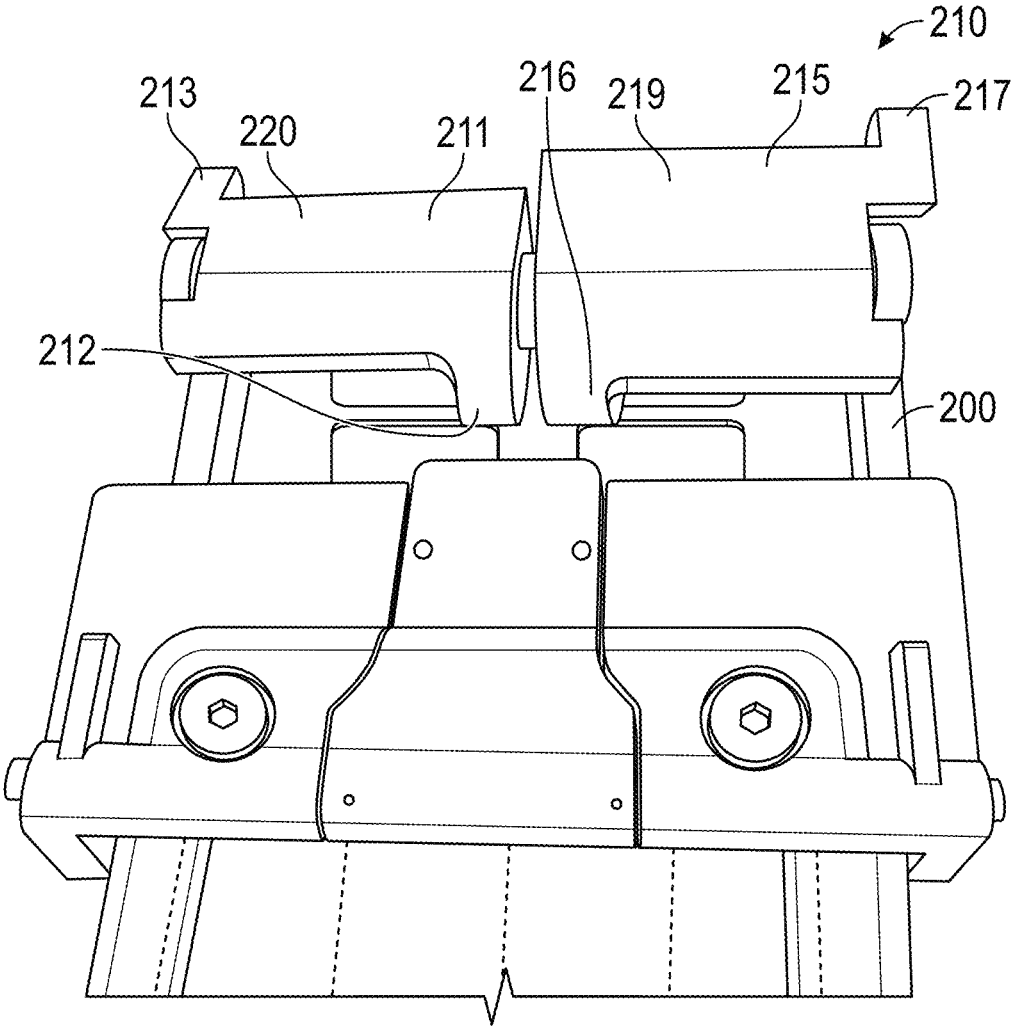
FIG. 7 shows an alternate front view of the buckle according to the first illustrated embodiment.

FIG. 6 and FIG. 7 show a front view of the buckle (200) with various positions (locked vs. released) of a first pawl (211) and a second pawl (215). The buckle comprises a ratcheting mechanism (210) including the first and second pawls. The first and second pawls include a first release lever (213) and a second release lever (217). When the first and second release levers are pressed, a corresponding first ratcheting tab (212) and a corresponding second ratcheting tab (216) are lifted, thereby causing the first and second pawls to be in a second rotation direction (220) of a released state. When both the first and second pawls are in the second rotation direction, a belt can releasably disengage from the ratcheting mechanism. If only the first pawl is in the second rotation direction while the second pawl is not, the second pawl is in a first rotation direction (219) of a locked state. While the second pawl remains in the first rotation direction, the ratcheting mechanism will remain engaged with a notch strip of the belt. It will be appreciated by one having skill in the art that the first pawl can be in the first rotation direction of the locked state and the second pawl can be in the second rotation direction of the released state, and in such a configuration the ratcheting mechanism will also remain engaged with the notch strip.

The belt and buckle can be manufactured and fabricated with materials and methods known to one having skill in the art. Generally, materials for the buckles may include various metals and/or thermoplastics. Belts generally comprise leather, plastic, heavy cloth, or the like.

While various details, features, and combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

FEATURE LIST belt (100)
first end (101)
second end (102)
notch strip (103)
plurality of notches (104)
first row of plurality of notches (105)
second row of plurality of notches (106)
buckle (200)
first side (201)
second side (202)
body (203)
receptacle portion (204)
ratchet pin (205)
torsion spring (206)
washer (207)
exit slot (208)
gap (209)
ratcheting mechanism (210)
first pawl (211)
first ratcheting tab (212)
first release lever (213)
first mechanical stop tab (214)
second pawl (215)
second ratcheting tab (216)
second release lever (217)
second mechanical stop (218)
first rotation direction (219)
second rotation direction (220)
first groove (221)
second groove (222)

What is claimed is:

1. A ratchet buckle comprising:
a body extending from a first side to a second side;
a receptacle portion disposed at the first side,
the receptacle portion comprising an anchoring mechanism configured to fixedly couple to a belt;
a ratchet pin extending across the body, wherein the ratchet pin is disposed between the first side and the second side; and
a ratcheting mechanism disposed adjacent to the second side, the ratcheting mechanism configured to engage with said belt, the ratcheting mechanism comprising:
a first pawl rotatably coupled to the ratchet pin, the first pawl comprising a first ratcheting tab and a first release lever, the first release lever configured to rotate the first pawl,
a second pawl rotatably coupled to the ratchet pin, the second pawl comprising a second ratcheting tab and a second release lever, the second release lever configured to rotate the second pawl,
wherein the first pawl and the second pawl independently rotate about the ratchet pin;
further wherein the first pawl and the second pawl are configured to simultaneously engage with the belt such that upon the first pawl being in a released state and the second pawl being in a locked state, the belt is configured to remain engaged with the ratcheting mechanism.

2. The ratchet buckle of claim 1, further comprising a gap disposed between the first pawl and the second pawl.

3. The ratchet buckle of claim 1, the ratcheting mechanism further comprising a first torsional spring coupled to each of the first pawl and the ratchet pin, and a second torsional spring coupled to each of the second pawl and the ratchet pin.

4. The ratchet buckle of claim 1, wherein the first pawl is in a mirror configuration with the second pawl.

5. The ratchet buckle of claim 1, the ratchet pin further comprising a first ratchet pin and a second ratchet pin such that the first ratchet pin and the second ratchet pin are separate and distinct, wherein the first pawl is rotatably coupled to the first ratchet pin and the second pawl is rotatably coupled to the second ratchet pin.

6. The ratchet buckle of claim 1, the first pawl further comprising a first mechanical stop tab and the second pawl further comprising a second mechanical stop tab wherein the first mechanical stop tab is configured to contact the body by rotation of the first pawl to prevent over rotation of the first pawl, and the second mechanical stop tab is configured to contact the body by rotation of the second pawl to prevent over rotation of the second pawl.

7. The ratchet buckle of claim 1, further comprising a single belt pathway disposed between the body and each of the first pawl and the second pawl wherein the single belt pathway is configured to receive the belt.

8. The ratchet buckle of claim 1, wherein the first release lever and the second release lever each pivot towards the body to unlock the ratcheting mechanism.

9. A ratchet buckle and belt system, the system comprising:

a belt having a first end and a second end opposite the first end, the belt further comprising a notch strip disposed adjacent to the second end; and a ratchet buckle comprising:

a body extending from a first side to a second side, a receptacle portion disposed at the first side, the receptacle portion being configured to couple to the first end of the belt, a ratchet pin extending across the body, wherein the ratchet pin is disposed between the first side and the second side, and a ratcheting mechanism disposed adjacent to the second side, the ratcheting mechanism comprising:

a first pawl rotatably coupled to the ratchet pin, the first pawl comprising a first ratcheting tab and a first release lever, the first release lever configured to rotate the first pawl and disengage the first ratcheting tab from the notch strip, a second pawl rotatably coupled to the ratchet pin, the second pawl comprising a second ratcheting tab and a second release lever, the second release lever configured to rotate the second pawl and disengage the second ratcheting tab from notch strip, wherein the first pawl and the second pawl independently rotate about the ratchet pin;

wherein the ratcheting mechanism is configured to disengage from the belt when both the first and second ratcheting tabs are simultaneously disengaged from the notch strip.

10. The system of claim 9, further comprising a gap disposed between the first pawl and the second pawl.

11. The system of claim 9, the ratcheting mechanism further comprising a first torsional spring coupled to the first pawl and the ratchet pin, and a second torsional spring coupled to the second pawl and the ratchet pin.

12. The system of claim 9, the ratchet pin comprising a first ratchet pin and a second ratchet pin such that the first ratchet pin and the second ratchet pin are separate and distinct, wherein the first pawl is rotatably coupled to the first ratchet pin and the second pawl is rotatably coupled to the second ratchet pin.

13. The system of claim 9, the first pawl further comprising a first mechanical stop tab and the second pawl further comprising a second mechanical stop tab wherein the first mechanical stop tab is configured to contact the body by rotation of the first pawl to prevent over rotation of the first pawl, and the second mechanical stop tab is configured to contact the body by rotation of the second pawl to prevent over rotation of the second pawl.

14. A method of disengaging a ratchet buckle from a belt, the belt having a notch strip, comprising:

rotating a first pawl of the ratchet buckle;

disengaging the first pawl from a first row of plurality of notches of the notch strip;

rotating a second pawl of the ratchet buckle wherein the second pawl and the first paw are independently rotatable;

disengaging the second pawl from a second row of plurality notches of the notch strip;

forming a released state when both the first pawl and the second pawl are simultaneously disengaged from the notch strip; and while in the released state, disengaging the belt from the ratchet buckle.

* * * * *